US007104069B2

(12) United States Patent
Martling et al.

(10) Patent No.: US 7,104,069 B2
(45) Date of Patent: Sep. 12, 2006

(54) APPARATUS AND METHOD FOR IMPROVING COMBUSTION STABILITY

(75) Inventors: Vincent C. Martling, Jupiter, FL (US); James H. Leahy, Jr., Tequesta, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 492 days.

(21) Appl. No.: 10/603,208

(22) Filed: Jun. 25, 2003

(65) Prior Publication Data

US 2004/0265136 A1 Dec. 30, 2004

(51) Int. Cl.
*F02C 3/30* (2006.01)
*F23R 3/36* (2006.01)

(52) U.S. Cl. ..... 60/775; 60/39.55

(58) Field of Classification Search ..... 60/775, 60/39.55; 431/163
See application file for complete search history.

(56) References Cited

U.S. PATENT DOCUMENTS 2,306,141 A * 12/1942 Richardson ..... 239/404
4,025,282 A * 5/1977 Reed et al. ..... 431/11
4,268,017 A * 5/1981 Cole ..... 266/265
4,977,740 A * 12/1990 Madden et al. ..... 60/39.55
5,211,004 A 5/1993 Black
5,361,578 A 11/1994 Donlan
5,720,164 A * 2/1998 Corbett et al. ..... 60/39.53
5,727,377 A * 3/1998 Fetescu et al. ..... 60/775
6,311,471 B1 * 11/2001 Waldherr et al. ..... 60/39.55
6,418,724 B1 * 7/2002 Cheng ..... 60/39.55

* cited by examiner

*Primary Examiner*—Ted Kim
(74) *Attorney, Agent, or Firm*—Shook Hardy & Bacon, LLP

(57) ABSTRACT

A fuel nozzle for use in a gas turbine combustor is provided having the capability of injecting multiple fuel types as well as steam for NOx reduction. Combustion dynamics within a combustor due to the mal-distribution of steam are controlled by the placement of a meterplate at the steam inlet, such that the meterplate reduces steam velocity and increases steam pressure drop. A higher pressure drop reduces the sensitivity of the combustion process to upstream steam supply variations. A method for providing uniform steam flow to a plurality of fuel nozzle assemblies about a gas turbine engine is also disclosed.

3 Claims, 1 Drawing Sheet

APPARATUS AND METHOD FOR IMPROVING COMBUSTION STABILITY

BACKGROUND OF THE INVENTION

1. Field of the Invention

The present invention relates to fuel nozzles for gas turbine combustors and more specifically to fuel nozzles that utilize multiple fuel types and have the capability for steam injection to control emissions of oxides of nitrogen (NOx).

2. Description of Related Art

Land based gas turbine engines typically include at least one combustor for producing hot gases necessary to drive the turbine section of the engine. Each combustor contains at least one fuel nozzle for injecting fuel to mix with compressed air from the engine compressor and react to form the hot gases. Depending on engine operating requirements and environmental issues, the fuel nozzles can inject multiple fuel types, including gaseous fuel and liquid fuel. In recent years, reductions in emissions levels, especially with respect to NOx and carbon monoxide (CO), have been the main focus of equipment manufacturers, especially since the operation of these types of engines are regulated primarily by their emissions output.

A well-known means to minimize NOx formation in a combustor having a dual fuel nozzle involves injecting steam, from the fuel nozzle, into the combustion chamber. NOx formation in a combustor is a function of flame temperature, where higher flame temperatures create higher levels of NOx emissions. Steam injection reduces the overall flame temperature, thereby creating lower NOx levels. However, if the steam is not injected with a high enough pressure drop across the steam circuit or at too high of a velocity, flow mal-distributions can occur where some regions of a combustion system receive excessive amounts of steam and other areas not receiving enough steam, thereby resulting in high combustion dynamics. High levels of combustion dynamics have been known to significantly reduce hardware life.

Therefore, what is needed is a fuel nozzle capable of injecting liquid fuel, gaseous fuel, or both simultaneously, along with steam, where the flow of steam through the nozzle to the combustor is regulated to reduce undesirable combustion dynamics.

SUMMARY AND OBJECTS OF THE INVENTION

The present invention seeks to overcome the shortcomings of the prior art by providing a fuel nozzle having a structure to regulate steam injection into a combustor to reduce combustion dynamics as well as to disclose a method of providing uniform steam flow to a combustor.

A fuel nozzle is provided having a first fuel passage and first fuel injection means, a second fuel passage and second fuel injection means, an air passage and air injection means, and a steam passage and steam injection means. In the preferred embodiment, the second fuel passage is located along the nozzle centerline with the air passage radially outward of the second fuel passage, and the steam passage radially outward of the air passage. Lastly, the first fuel passage is located radially outward of the steam passage. The steam passage is supplied with steam by a steam inlet that is connected to a steam manifold where the steam manifold supplies steam to each fuel nozzle. In order to control the steam flow to the fuel nozzle, a meterplate having at least one metering hole of constant diameter is placed at the steam inlet. The meterplate, in conjunction with the steam passage geometry and steam injection means, serves to regulate the pressure drop of the steam as well as the velocity of the steam. Controlling the pressure drop and velocity allows the operator to minimize the mal-distribution effects within a single combustor or between multiple combustors and reduce sensitivity to upstream steam supply variations, each of which reduce potentially damaging combustion dynamics. A further advantage of the present invention relates to the reduction of the exhaust gas temperature spread.

Typically, exhaust gases can vary by as much as 80 degrees Fahrenheit between adjacent combustors, thereby exposing the turbine to varying inlet temperatures, causing thermal distress to the vanes and blades. By maintaining better control over the steam flow for each combustor, such that each combustor receives the required amount of steam to match the fuel flow rate, variance in combustor flame temperature is reduced by as much as 50%.

It is an object of the present invention to provide a fuel nozzle capable of dual fuel injection and steam injection, where the steam is injected uniformly into a combustor.

It is another object of the present invention to reduce combustion dynamics to a combustor containing a fuel nozzle capable of dual fuel injection and steam injection.

It is yet another object of the present invention to disclose a method of providing uniform steam flow to a plurality of fuel nozzle assemblies about a gas turbine engine.

In accordance with these and other objects, which will become apparent hereinafter, the instant invention will now be described with particular reference to the accompanying drawings.

DETAILED DESCRIPTION OF THE PREFERRED EMBODIMENT

Figure 1:
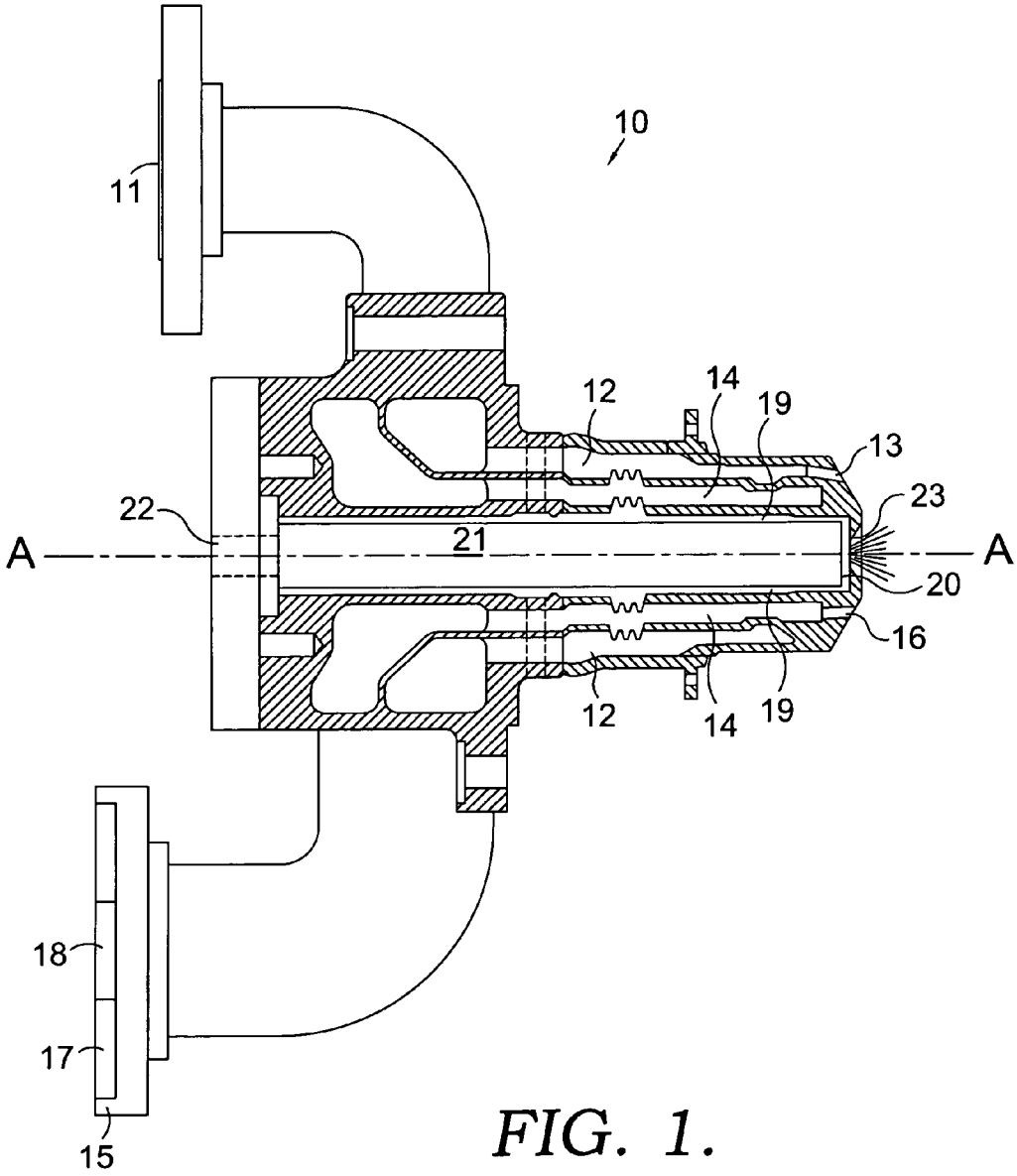
FIG. 1 is a cross section of a fuel nozzle assembly in accordance with the present invention.

Referring to FIG. 1, a fuel nozzle assembly in accordance with the present invention is shown in cross section. Fuel nozzle assembly 10 includes a first fuel inlet 11 in fluid communication with a first fuel passage 12 and a first fuel injection means 13, such that a first fuel is supplied to a combustor. Located radially inward from first fuel passage 12 is a steam passage 14 that receives steam from a steam inlet 15 and directs it to a steam injection means 16 for supplying steam to a combustor. Steam flow to nozzle assembly 10 is regulated at steam inlet 15, preferably by a meterplate 17 that is fixed to steam inlet 15 and contains at least one metering hole 18 having a constant diameter. In the preferred embodiment, a single metering hole having a diameter of at least 0.25 inches is utilized, however multiple metering holes can be used in place of a single hole if desired. Meterplate 17 and metering hole 18 create an obstruction in the steam flow that reduces the fluid velocity and increases the pressure drop, such that when combined with the geometry of the steam circuit, a regulated and evenly distributed steam flow is created.

Radially inward of steam passage 14 is an air passage 19 in communication with air injection means 20 for supplying air to a combustor. Fuel nozzle assembly 10 further includes a second fuel passage 21 located along its center axis A—A and radially inward of air passage 19. Second passage 21 is in fluid communication with a second fuel inlet 22 and second fuel injection means 23 for supplying a second fuel to a combustor. Regarding injection of the fuels into the combustor, it is preferred that first fuel injection means 13 and second fuel injection means 23 each contain a plurality of injection holes located in an annular array about center axis A—A.

In the preferred embodiment, first fuel inlet 11 supplies a gaseous fuel to first fuel passage 12 while second fuel inlet 22 supplies a liquid fuel, such as oil, to second fuel passage 21. Furthermore, it should be noted that first fuel passage 12, second fuel passage 21, steam passage 14, and air passage 19 could each be single annular passages or multiple passages each arranged in an annular array about the fuel nozzle center axis.

The present invention further comprises a method of providing uniform steam flow to a plurality of fuel nozzle assemblies about a gas turbine engine. The method includes the steps of (a) providing a gas turbine engine having a plurality of combustors and a manifold containing steam, (b) providing a plurality of fuel nozzle assemblies, each fuel nozzle assembly constructed in accordance with the previously defined fuel nozzle structure, (c) providing a means to flow steam from the steam manifold to each of the fuel nozzle assemblies, (d) determining a first flow rate of steam through each fuel nozzle assembly, (e) inserting a meterplate into each fuel nozzle assembly at the steam inlet, where each meterplate has a metering hole with an effective flow area that depends on the first flow rate, wherein the metering hole restricts the flow of steam, thereby creating a pressure drop and change in velocity, resulting in equivalent steam flow to all nozzle assemblies, and (f) determining a second flow rate of steam through each fuel nozzle assembly to verify equivalent steam flow to each fuel nozzle assembly. Should the steam flow rates not be relatively the same, steps (d)–(f) are repeated as necessary by adjusting the metering hole size in the meterplate. In the preferred embodiment, the meterplate increases the pressure drop of the steam across the fuel nozzle by a factor of approximately two.

While the invention has been described in what is known as presently the preferred embodiment, it is to be understood that the invention is not to be limited to the disclosed embodiment but, on the contrary, is intended to cover various modifications and equivalent arrangements within the scope of the following claims.

We claim:

1. The method of providing uniform steam flow to a plurality of fuel nozzle assemblies about a gas turbine engine, said method comprising the steps:

a. providing a gas turbine engine having a plurality of combustors and a manifold containing steam;

b. providing a plurality of fuel nozzle assemblies, each of said fuel nozzle assemblies having:

a first fuel inlet in fluid communication with a first fuel passage and first fuel injection means for supplying a first fuel to a combustor;

a steam inlet in fluid communication with a steam passage and steam injection means for supplying steam to a combustor;

an air passage and air injection means for supplying air to a combustor;

c. providing a means to flow steam from said manifold to each of said fuel nozzle assemblies;

d. determining a first flow rate of steam through each of said fuel nozzle assemblies;

e. inserting a meterplate into each of said fuel nozzle assemblies at said steam inlets, each meterplate having a metering hole with an effective flow area that depends on said first flow rate, wherein said metering hole restricts the flow of steam thereby creating a pressure drop and resulting in equivalent steam flow to all nozzle assemblies;

f. determining a second flow rate of steam through each of said fuel nozzle assemblies to verify equivalent steam flow to all nozzle assemblies.

2. The method of claim 1 wherein said metering hole in said meterplate increases said pressure drop across said fuel nozzle by a factor of approximately two.

3. A combustion system for a gas turbine engine comprising:

a plurality of combustors;

a manifold containing steam;

a plurality of fuel nozzle assemblies in each of said combustors, each of said fuel nozzle assemblies having:

a first fuel inlet in fluid communication with a first fuel passage and first fuel injection means for supplying a first fuel to a combustor;

a steam inlet in fluid communication with a steam passage and steam injection means for supplying steam to a combustor;

an air passage and air injection means for supplying air to a combustor;

means to flow steam from said manifold to each of said fuel nozzle assemblies;

a meterplate in each of said fuel nozzle assemblies at said steam inlets, each meterplate having a metering hole with an effective flow area that restricts the flow of steam therethrough; each meterplate being sized for equivalent steam flow to all nozzle assemblies;

wherein the effective flow area of at least one of said metering holes is greater than at least one of the other metering holes.

* * * * *